United States Patent [19]

Krec

[11] Patent Number: 4,559,504

[45] Date of Patent: Dec. 17, 1985

[54] FUSE TERMINAL

[75] Inventor: Zdenek Krec, Regensburg, Fed. Rep. of Germany

[73] Assignee: Siemens Aktiengesellschaft, Fed. Rep. of Germany

[21] Appl. No.: 569,382

[22] Filed: Jan. 9, 1984

[51] Int. Cl.[4] ..... H01H 85/02

[52] U.S. Cl. ..... 337/194; 337/213; 361/432

[58] Field of Search ..... 337/194, 195, 196, 213; 361/432; 339/147

[56] References Cited

U.S. PATENT DOCUMENTS 1,966,716 7/1934 Green ..... 337/194
3,766,515 10/1973 Debaigt ..... 339/198 R

FOREIGN PATENT DOCUMENTS 3146914 1/1983 Fed. Rep. of Germany .
2124242 9/1972 France .

*Primary Examiner*—Harold Broome
*Attorney, Agent, or Firm*—Scully, Scott, Murphy & Presser

[57] ABSTRACT

A series or multiple-contact terminal having a socket in which stationary contacts are arranged for cooperative engagement with switching contacts on an operating element. The switching contacts are formed through a retainer for fuse inserts with two contact elements which are located spaced apart opposite each other on a fuse carrier; wherein the fuse carrier is retained so as to be rotatable and lockable within a guide member, with the guide element being guided within the base so as to displaceable and withdrawable therefrom; and wherein the fuse carrier cover the stationary contacts in the socket secure against touching by means of cover rails in the inserted as well as in the raised position, and whereby in the raised and transversely rotated position these rails provide an access for the retention of the fuse insert.

15 Claims, 12 Drawing Figures

FUSE TERMINAL

BACKGROUND OF THE INVENTION

1. Field of the Invention

The present invention relates to a series or multiple-contact terminal having a socket in which stationary contacts are arranged for cooperative engagement with switching contacts on an operating element.

2. Discussion of the Prior Art

Series terminals of that type are presently known in different versions or constructions; for example, as is disclosed in German Pat. No. 26 01 849.

Currently, series or multiple-contact terminals are also being marketed and which are constructed as fuse boxes or terminals; in essence, which possess contacts located between binding posts or terminals for a fuse insert which is to be positioned therein. Thus, in a known fuse terminal, such as that disclosed in German Published patent application No. 23 64 972, having a socket in the shape of a series or multiple-contact terminal, a pivot lever is supported so as to be pivotable about an axis and longitudinally displaceable due to the presence of an elongate aperture, and which is constructed as the bottom portion for a fuse insert. In the snapped-in condition, spring contacts provide for electrical contact with contact members located in the socket. Although, when in its withdrawn condition, the fuse insert can be exchanged without being subjected to voltage; nevertheless, in the base of the terminal there are exposed contact elements and, as a result, also the contact member which stands under voltage. Consequently, no protection is afforded against the inadvertent touching of voltage-carrying elements, so as to fail to fulfill safety requirements with regard to finger contact.

SUMMARY OF THE INVENTION

Accordingly, it is an object of the present invention to so develop a series or multiple-contact terminal with stationary contacts in the socket, and with switching contacts located on an operating element, so as to form a fuse terminal wherein in every switching position, such as on, off and during changing of the fuse insert, there is afforded safety with respect to any finger touching of voltage-carrying elements.

The object of the present invention is achieved in that, in the arrangement, the switching contacts are formed through a retainer for fuse inserts with two contact elements which are located spaced apart opposite each other on a fuse carrier; wherein the fuse carrier is retained so as to be rotatable and lockable within a guide member, with the guide element being guided within the base so as to displaceable and withdrawable therefrom; and wherein the fuse carrier covers the stationary contacts in the socket secure against touching by means of cover rails in the inserted as well as in the raised position, and whereby in the raised and transversely rotated position these cover rails provide an access to the retention of the fuse insert.

In order to provide for an exchange of the fuse inserts in the inventive fuse terminal, the fuse carrier together with the guide element is raised out of the base into the switched-off position, and then rotated transversely relative to the guide member. The fuse insert can be safely exchanged without the danger that any voltage-carrying components can be touched with the fingers or manipulated into impermissible current discharge.

In accordance with a modified embodiment of the invention, on the fuse carrier above the retainer for the contact-forming fuse insert, there is provided at least one further retainer for a replacement fuse insert. Hereby, the space which is required for the switching movement can be utilized for the accommodation of a replacement fuse. The fuse terminal thereby does not need to be constructed any larger in size for the accommodation of a replacement fuse.

An especially material-saving and easily assembled fuse terminal is obtained when the fuse carrier incorporates an operating element which forms a transition below a shoulder extending as a cover rail, into an axially located member which is locked together with an extension of the cover rail extending about the space provided for the accommodation of the fuse insert or fuse inserts. Achieved hereby is a stable fuse carrier which, in conjunction with the socket, affords protection to the fingers in every switching position.

It is also possible to easily eject the fuse insert through mere finger pressure being exerted from the outside against the operating element and extension of the cover rail without any difficult effort, when the extension of the cover rail forms a tongue at the latching location, whose a reverse hook-like projecting back is engaged by a knub on the member, whose back towards the tip of the tongue operates wedge-like against a cooperating bearing surface formed on the member, and whose front side conforms with the shape of the fuse insert. This front side is then a part of the retainer for the fuse insert, wherein a weakened location can be formed in the extension of the cover rail in the type of a molded film hinge, in order to render the ejection of the fuse insert particularly easy.

BRIEF DESCRIPTION OF THE DRAWINGS

Reference may now be had to the following detailed description of preferred exemplary embodiments of the invention, taken in conjunction with the accompanying drawings; in which.

DETAILED DESCRIPTION

Figure 1:
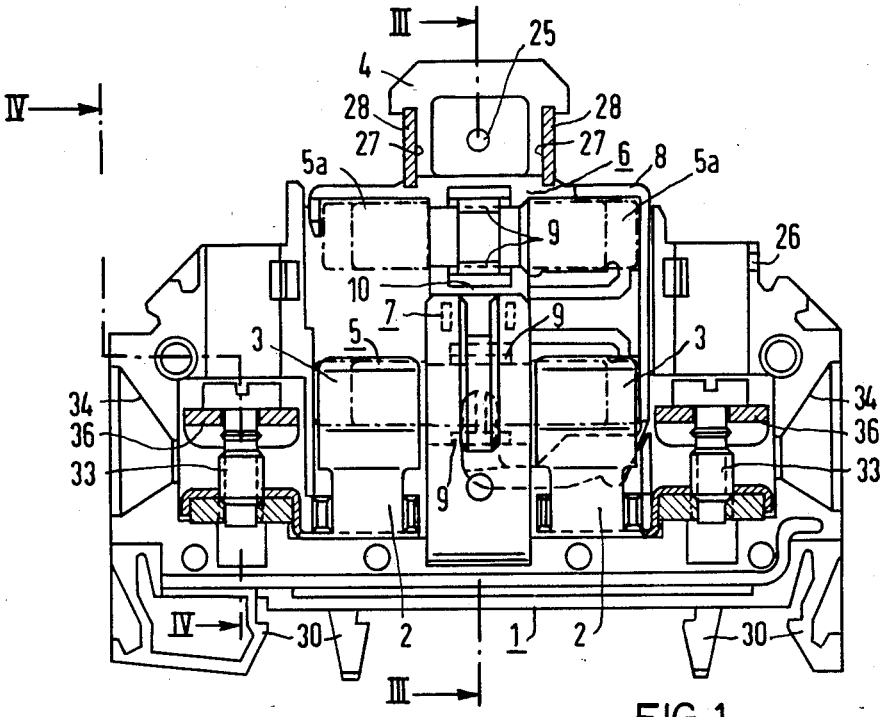
FIG. 1 illustrates a side view of the fuse terminal with the cover thereof removed, wherein the individual components of the fuse terminal can be presumed to be inserted into one-half of two assemblable housing casing segments.
Figure 5:
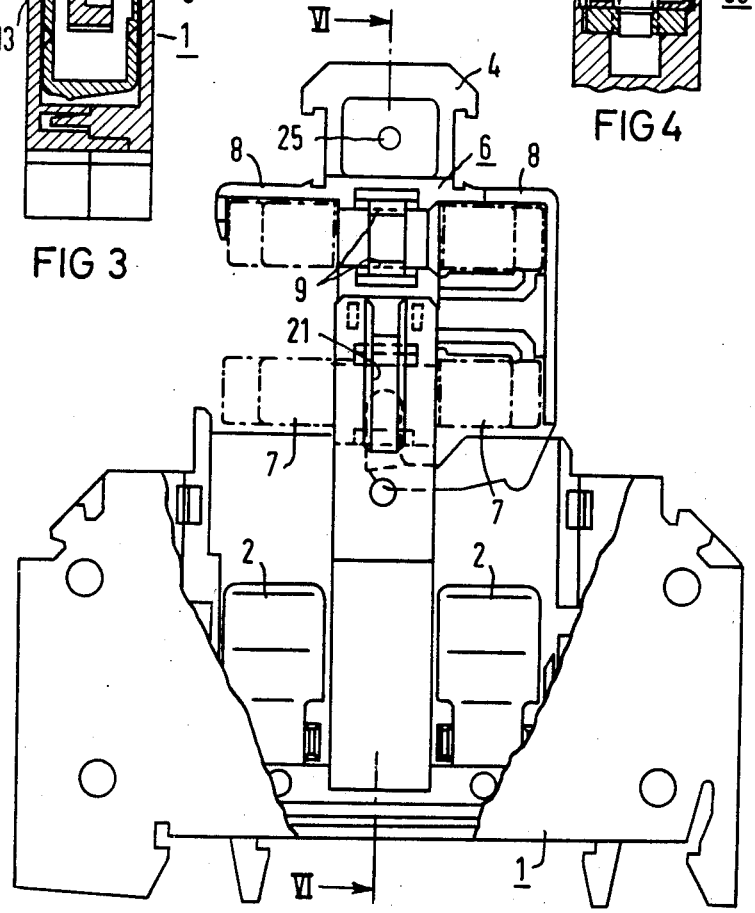
FIG. 5 illustrates the fuse terminal of FIG. 1 in the lifted out position of the fuse carrier, in effect in the switched off position.
Figure 7:
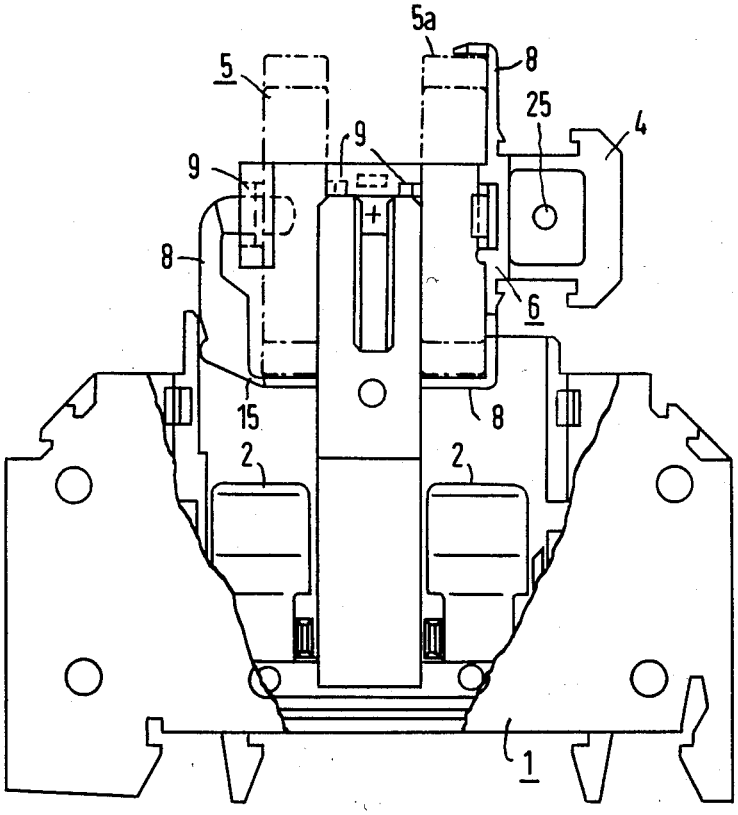
FIG. 7 illustrates the fuse terminal in a position for an exchange of the fuse insert.

A fuse terminal according to FIG. 1 includes a base in the type of series terminals in which there are arranged stationary contacts 2 operating in conjunction with switching contacts 3, the latter of which are associated with an operating element 4. The switching contacts 3 are formed on a fuse carrier 6 by means of a retainer 9 for fuse inserts 5 with two oppositely spaced contact elements, the contact heads. The fuse carrier 6 is rotatably supported in a guide member 7 which, in turn, is liftably and displaceably guided in the socket 1. The fuse carrier 6 hereby locks in its horizontal position. It closes off the socket 1 through cover rails 8 in the inserted position, as shown in FIG. 1, as well as in the raised position, as shown in FIGS. 5 and 7. In the raised and rotated position pursuant to FIG. 7, the cover rails 8 provide an access to the retainer 5 for the left fuse insert 5.

In the embodiment pursuant to FIG. 1, the fuse carrier 6 incorporates, above the retainer 9 for the contact forming fuse insert 5 at least one further retainer or holder 9 for a replacement fuse insert 5*a*. In the position for the exchange of fuse insert 5 as shown FIG. 7, there can also be withdrawn the replacement fuse insert 5*a*.

The fuse insert 6 includes an operating element 4 which forms a transition below an elongated shoulder constituting a cover rail 8 into an axially arranged member 10, as can be ascertained particularly from FIG. 2. The member 10 is locked to an extension of the cover rail 8 which is conducted about the space for the accommodation of the fuse insert or the fuse inserts. For this purpose, the extension of the cover rail forms a tongue 11 at the latching location, referring also to FIG. 3, whose reverse hook like protruding back surface 12 is engaged by a nub or projection 13 on the member 10. The back surface of the tongue 11 acts in a wedge-like manner against a complementary bearing surface 14 on the member 10, as shown in FIG. 3. The front side of the tongue is in conformance with the shape of the fuse insert 5. The tongue 11 is thereby a part of the retainer 9 for the fuse insert 5.

Figure 2:
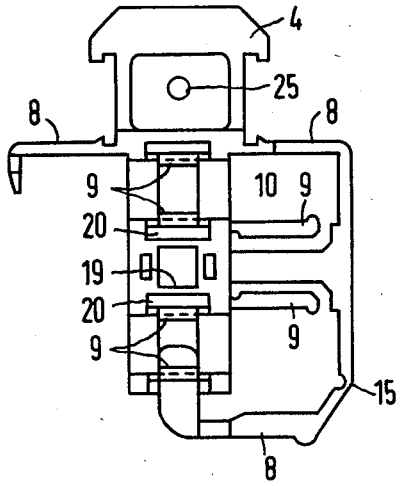
FIG. 2 illustrates the fuse carrier for the fuse terminal of FIG. 1.
Figure 3:
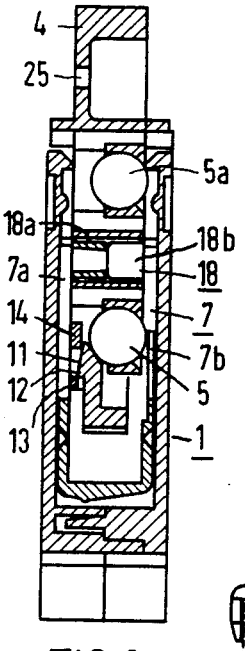
FIG. 3 is a sectional view taken along line III—III through the fuse terminal of FIG. 1, illustrated with the cover mounted therein.
Figure 8:
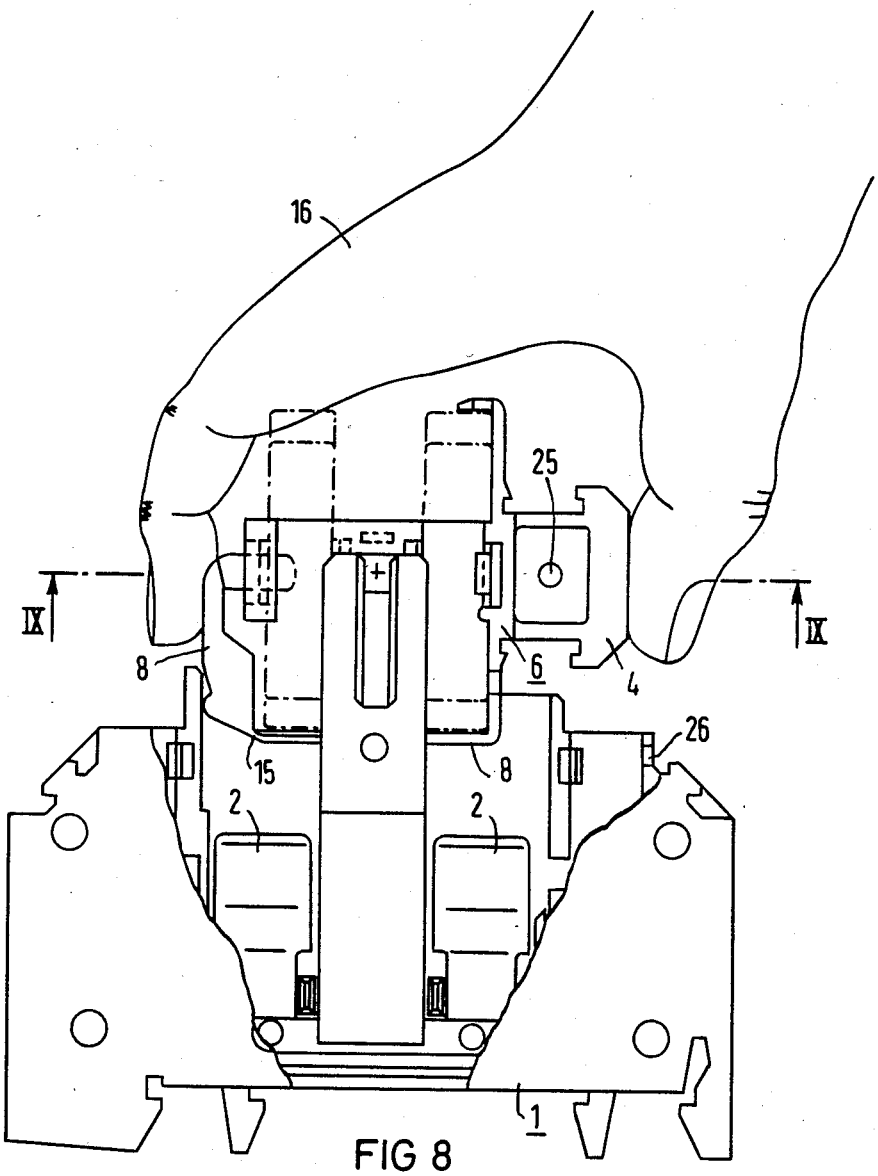
FIG. 8 illustrates the fuse terminal pursuant to FIG. 7, indicating the manner in which the fuse insert can be ejected through finger pressure exerted against the operating element and the extension of the cover rail of the fuse carrier.
Figure 9:
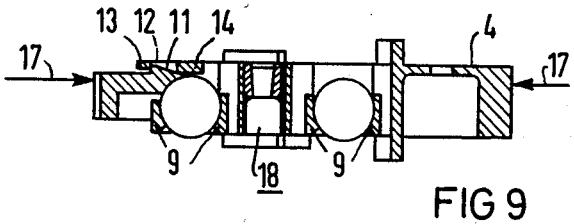
FIG. 9 is a sectional view taken along line IX—IX in FIG. 8.

Formed in the extension of the cover rail 8 pursuant to FIG. 2 is a weakened location 15 in the type of a molded or cast film hinge. In the position for the exchange of the fuse insert, according to FIG. 7 and FIG. 8, the fuse insert 5 can be ejected by exerting pressure against the operating element 4 and onto the extension of the cover rail 8. In FIG. 9 there is presently illustrated, by means of an arrow 17, the pressure which is exerted through the fingers of a hand 16.

The guide member 7 according to FIG. 3 includes a tetragonal spindle 18 which engages into a corresponding recess 19 formed in the member 10 of the fuse carrier 6 pursuant to FIG. 2. The wall of the recess 19 is hereby resiliently constructed by means of open cuts 20. Consequently, the fuse carrier 6 moves from the position "off", as shown in FIG. 5, with secure engagement into the position "exchange of the fuse insert", as shown in FIGS. 7 and 8.

The guide member 7 when referring, for example, to FIG. 3, is essentially formed in a three-dimensional U-shape. Its oppositely arranged side walls 7*a* and 7*b* form at their free ends the tetragonal spindle 18 through two pressure knob-like interlocking extensions 18*a* and 18*b*.

Figure 6:
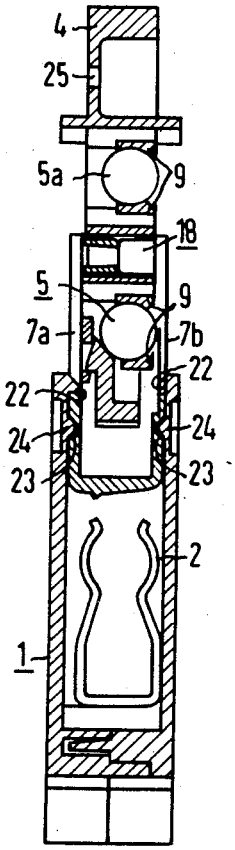
FIG. 6 is a sectional view through the fuse terminal taken along line VI—VI in FIG. 5, with the cover shown assembled.

The guide member 7 pursuant to FIGS. 5 and 6 evidences groove-like recesses 21 extending from the outside of the side walls which for example, are bifurcated in the embodiment, the free side wall ends and above the base of the walls. Engaging into these recesses 21 is a reverse hook-like protuberance 22 of the socket, so as to limit the extent of raising of the guide member 7 and thereby of the fuse carrier 6.

In order to prevent any dropping back of the fuse carrier together with its guide member 7 downwardly into the "switched-on" position, there is presently formed between the base of the walls and the recess 21 in the guide member 7, a nub-like recess 23 in the side walls, into which there engages a knob-like protuberance 24 of the socket 1 in the raised up position of the fuse carrier.

Pursuant to FIG. 8, formed in the operating element 4 and in an adjoining wall of the socket 1 in raised in rotated position of the former, are seal apertures 25 and 26. This will prevent any subsequent switching on without breaking the seal.

The operating element 4 pursuant to FIG. 1, in the sequential direction of the series terminal which is constructed as a fuse terminal, forms sideways oriented grooves 27 into which there can engage the coupling rails 28 of adjoining fuse terminals. As a result, there can be operated a plurality of coupled fuse terminals.

Figure 10:
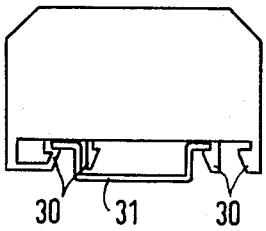
FIGS. 10 and 11 illustrates the manner in which the fuse terminal can be retained in, respectively, two different positions on a support rail in one embodiment of the socket base.
Figure 11:
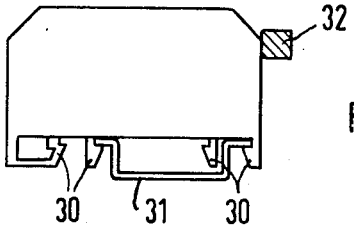

The socket base of the fuse terminal, in a known manner, can include retaining arms 30 as shown in FIG. 1, in order to be able to fasten the fuse terminals to carrier rails. The retaining arms 30, however, operate together in pairs in such a manner that the fuse terminal can be mounted on one carrier rail 30 either centrally or at the ends, pursuant to FIGS. 10 and 11, whereby the contacting side can align with collector rails 32 for usual short series terminals.

Figure 4:
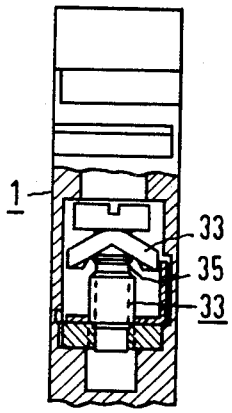
FIG. 4 is a sectional view taken along line IV—IV in FIG. 1, similar to that of FIG. 3.

Oriented on the basis of a side view of the fuse terminal, in addition to the space for the fuse inserts there can be arranged insulated terminals posts 33 in the socket wall, for example, according to FIGS. 1 and 4, whose terminal locations presently align with connector openings 34 at the end surface of the fuse terminal. The terminal posts 33 can incorporate below their screw heads suitable guide webs 35 or guide grooves for a pressure member 36 with a corresponding guide means. In the embodiment pursuant to FIG. 4, the pressure member 36 is positioned in a roof-like manner on the guide web 35. Obtained thereby is an exposed terminal into which a connecting conductor can be inserted without necessitating that the pressure member be previously manually raised.

Figure 12:
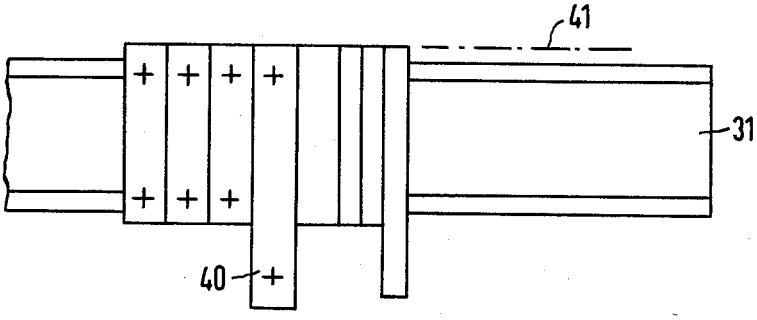
FIG. 12 illustrates the manner in which the fuse terminal can be arranged in series with other series or multiple-contact terminals on a carrier rail, wherein all series terminals align with each other at one end surface whereby they can be supplied through a common collector rail or current rail.

From FIG. 12 there can be ascertained the manner in which a fuse terminal 40 together with different types of series or multiple-contact terminals can be arranged on a carrier rail 31, for example, a normal box rail of 35 mm, so that its end surfaces close off on the supply side on a common alignment line 41.

What is claimed is:

1. A fuse terminal having a socket including stationary contacts, an operating element having a fuse carrier and switching contacts cooperating with the stationary contacts, said fuse carrier having said switching contacts formed thereon through a retainer for fuse inserts, said fuse inserts including two oppositely spaced switching contact elements, a guide member having said fuse carrier locked therein, said fuse carrier being rotationally mounted in said guide member, said guide member being displaceably and raisably supported in said socket, cover rails covering said fuse carrier and the stationary contacts in the socket against touching in the inserted as well as in the raised position thereof, and whereby in the raised and transversely rotated position said cover rail providing an access to the retainer for the fuse insert.

2. A fuse terminal as claimed in claim 1, including at least one further retainer for a replacement fuse insert being formed on said fuse carrier above the retainer for the contact forming fuse insert.

3. A fuse terminal comprising:

a socket including stationary contacts for holding a fuse insert;

an operating element having a fuse carrier for holding a fuse insert in a retainer thereon, said fuse insert having spaced switching contact elements that cooperate with said stationary contacts;

a guide member having said fuse carrier rotationally mounted therein, said guide member being displaceably and raisably supported in said socket, so that said fuse carrier may be lowered and raised to insert and remove said fuse inserts from said stationary contacts and said fuse carrier while in said raised position may be transversely rotated to remove and insert a replacement fuse insert in said fuse carrier; and cover rails covering said fuse carrier and said stationary contacts in said socket against touching in the inserted as well as in the raised position thereof, and whereby in the raised and transversely rotated position said cover rail providing an access to the retainer for said fuse insert.

4. Fuse terminal as claimed in claim 1 or 2 or 3, wherein the fuse carrier includes an operating element forming a transition below a shoulder extending into the cover rail into an axially arranged member, wherein said member is latched to an extension of the cover rail extending about the space for the accommodation of the fuse insert or inserts.

5. Fuse terminal as claimed in claim 4, wherein the extension of the cover rail forms a tongue at the locking location having a reverse hook-like protruding back, a nub on said member engaging said protruding back, wherein the rear surface in a wedge-shaped manner towards the tip of the tongue acts against a bearing surface formed on said member, and wherein the front side is correlated with the shape of the fuse insert and forms a portion of the retainer for the fuse insert, a weakening location in the type of a cast film hinge formed in the extension of the cover rail.

6. Fuse terminal as claimed in claim 1, wherein said guide member includes a tetragonal spindle engaging into a corresponding recess in a member of said fuse carrier, and cut-ins being formed in the wall of the recess so as to render said wall resilient.

7. Fuse terminal as claimed in claim 4, wherein said guide member has an essentially three-dimensional yield-shaped configuration, the opposite side walls at the free ends thereof forming the tetragonal spindle through two pressure knob-like interengaging extensions.

8. Fuse terminal as claimed in claim 5, wherein said guide member includes extending from the outside of one said side wall a groove-like or bifuricated recess intermediate the free wall ends and above the base of said walls into which there engages a reverse hook-like extension of said socket so as to limit the extent of lift of the guide member and of the fuse carrier.

9. Fuse terminal as claimed in claim 6, including a nub-like recess being formed intermediate the base of said walls and the recess of the guide member, and a knob-like extension of said socket extending into said recess in the raised position of said fuse carrier.

10. Fuse terminal as claimed in claim 9, comprising seal apertures being formed in said operating element and in a wall of socket adjacent thereto in the raised and rotated position thereof.

11. Fuse terminal as claimed in claim 4, including sideways-oriented grooves formed by said operating element in the serialized direction of said series terminal, and coupling rails engaging therein for adjoining fuse terminals.

12. Fuse terminal as claimed in claim 1, wherein the socket base of the fuse terminal includes retainer arms for carrier rails cooperating in pairs so that the fuse terminal can be mounted centrally or at the ends on a carrier rail so as to enable the contacting side to wind with collector rails of the usual short series terminals.

13. Fuse terminal as claimed in claim 1, wherein the side of the fuse terminal includes terminal posts insulated by the socket wall besides the space or the fuse inserts, the terminal locations presently aligned with connector openings at the end surface of the fuse terminal.

14. Fuse terminal as claimed in claim 13, wherein the terminal posts include guide webs below their screw heads or guide grooves for a pressure member with a corresponding guide means.

15. A fuse terminal as claimed in claim 14, including at least one further retainer for a replacement fuse insert being formed on said fuse carrier above the retainer for the contact forming fuse insert.

* * * * *